US008235685B2

(12) United States Patent
Moran et al.

(10) Patent No.: US 8,235,685 B2
(45) Date of Patent: Aug. 7, 2012

(54) TURBOCHARGER MOUNT WITH INTEGRATED EXHAUST AND EXHAUST GAS RECIRCULATION CONNECTIONS

(75) Inventors: Robert J Moran, Ann Arbor, MI (US); Iain J Read, Wixom, MI (US); Roman Mudel, Novi, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 970 days.

(21) Appl. No.: 12/189,842

(22) Filed: Aug. 12, 2008

(65) Prior Publication Data

US 2010/0040465 A1 Feb. 18, 2010

(51) Int. Cl.
*F02B 37/013* (2006.01)
*F02B 37/00* (2006.01)

(52) U.S. Cl. ..... 417/406; 60/605.2

(58) Field of Classification Search ..... 123/568.11–568.21; 417/406, 417/409; 60/612, 605.2
See application file for complete search history.

(56) References Cited

U.S. PATENT DOCUMENTS 6,263,672 B1 * 7/2001 Roby et al. ..... 60/605.2
6,430,929 B2 * 8/2002 Martin ..... 60/605.2
7,290,392 B2 11/2007 Jones
7,302,800 B2 * 12/2007 Klingel ..... 60/612

* cited by examiner

*Primary Examiner* — Calvin Lee

(74) *Attorney, Agent, or Firm* — Cantor Colburn LLP

(57) ABSTRACT

Exemplary embodiments of the present invention are directed towards an apparatus and method for fluidly coupling a turbocharger to an internal combustion engine. In one embodiment, a turbocharger mount for fluidly coupling a turbocharger to an exhaust system of an engine is provided. The turbocharger mount includes a housing portion and a mounting flange extending from the housing portion. The housing portion defines a cavity therein and a first inlet opening in fluid communication with the cavity, a first outlet opening in fluid communication with the cavity, and a second outlet opening in fluid communication with the cavity.

7 Claims, 5 Drawing Sheets

TURBOCHARGER MOUNT WITH INTEGRATED EXHAUST AND EXHAUST GAS RECIRCULATION CONNECTIONS

FIELD OF THE INVENTION

Exemplary embodiments of the present invention are directed towards an apparatus and method for fluidly coupling a turbocharger to an internal combustion engine.

BACKGROUND

Turbochargers are used with internal combustion engines for providing improved performance. In doing so, the turbochargers supply additional air to air intake systems of engines to increase potential energy. Typically, turbochargers are mounted to components of an engine, such as an exhaust manifold, and are in fluid communication with the exhaust manifold, intake manifold and optionally other components of an engine, such as an exhaust gas recirculation (EGR) device. However, misalignment between the turbocharger and these components may result due to forming or tolerance limitations and/or thermal movement of the components prior to and during operation of the engine. Accordingly, it is desirable to provide an improved apparatus and method for securing and fluidly connecting a turbocharger to an engine.

SUMMARY OF THE INVENTION

In one embodiment, a turbocharger mount for fluidly coupling a turbocharger to an exhaust system of an engine is provided. The turbocharger mount includes a housing portion and a mounting flange extending from the housing portion. The housing portion defines a cavity therein and a first inlet opening in fluid communication with the cavity, a first outlet opening in fluid communication with the cavity, and a second outlet opening in fluid communication with the cavity.

In another embodiment a method for fluidly coupling an intake of a turbocharger to an internal combustion engine is provided. The method includes coupling an exhaust gas conduit of the internal combustion engine to a cavity of a turbocharger mount that is separately manufactured and separately secured to the turbocharger. The turbocharger mount includes a housing portion with the cavity disposed therein and defines a first inlet opening, a first outlet opening and a second outlet opening each of which are in fluid communication with the cavity. The method further includes directing a first portion of an exhaust gas into the cavity through the first inlet opening and into the intake opening of the turbocharger through the first outlet opening and directing a second portion of the exhaust gas into the cavity and through the second outlet opening. The second outlet opening is fluidly coupled to an exhaust gas recirculation device of the internal combustion engine.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
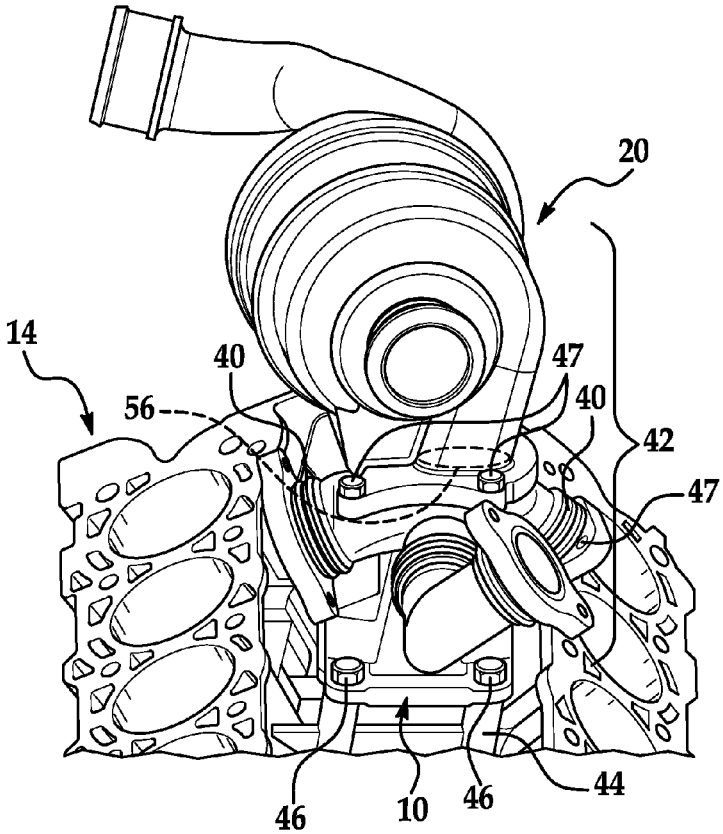
FIG. 1 illustrates a perspective view of a turbocharger mounted to a vehicle engine through a turbocharger mount in accordance with one exemplary embodiment of the present invention.
Figure 3:
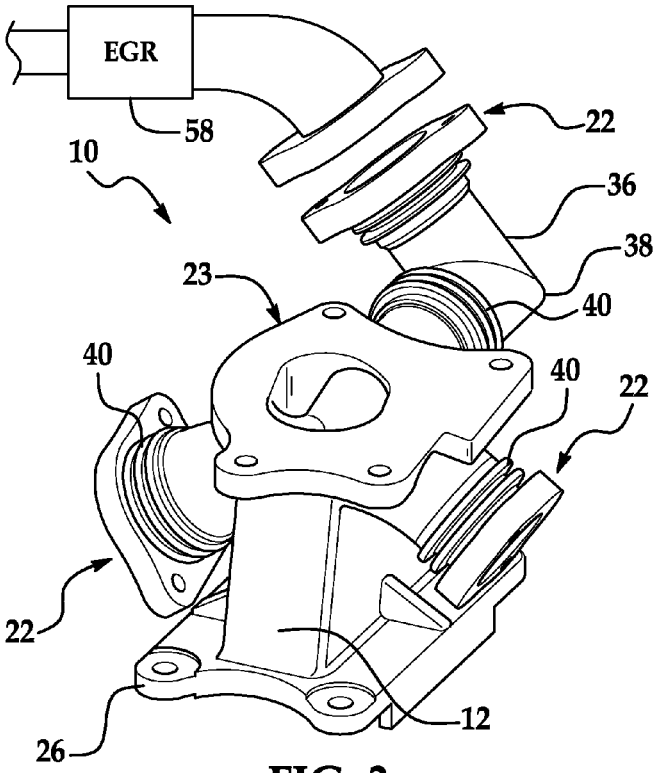
FIG. 3 illustrates another perspective view of the turbocharger mount shown in FIG. 1.

Referring to FIGS. 1 and 3, a turbocharger mount 10 is provided for a turbocharger 20. The turbocharger mount provides a means for mounting the turbocharger, receiving and directing exhaust gas of an engine 14 into an inlet opening 56 of the turbocharger, and supplying exhaust gas to an exhaust gas recirculation (EGR) device 58. As illustrated, the turbocharger mount 10 is configured as a pedestal that is separately attached to the engine block 44 and the turbocharger 20. Fluid communication between the turbocharger and the engine exhaust system and engine intake system is facilitated through passageways formed by the turbocharger mount. In addition, the turbocharger mount also includes flexible conduits 40 to allow for alignment of the components of the turbocharger mount to corresponding components of the engine 14, turbocharger 20 and/or EGR device 58 and thermal movement thereof. As will be shown and described herein, the various embodiments of the turbocharger mount 10 requires fewer parts and more robust mounting of a turbocharger to an engine block 44.

Figure 2:
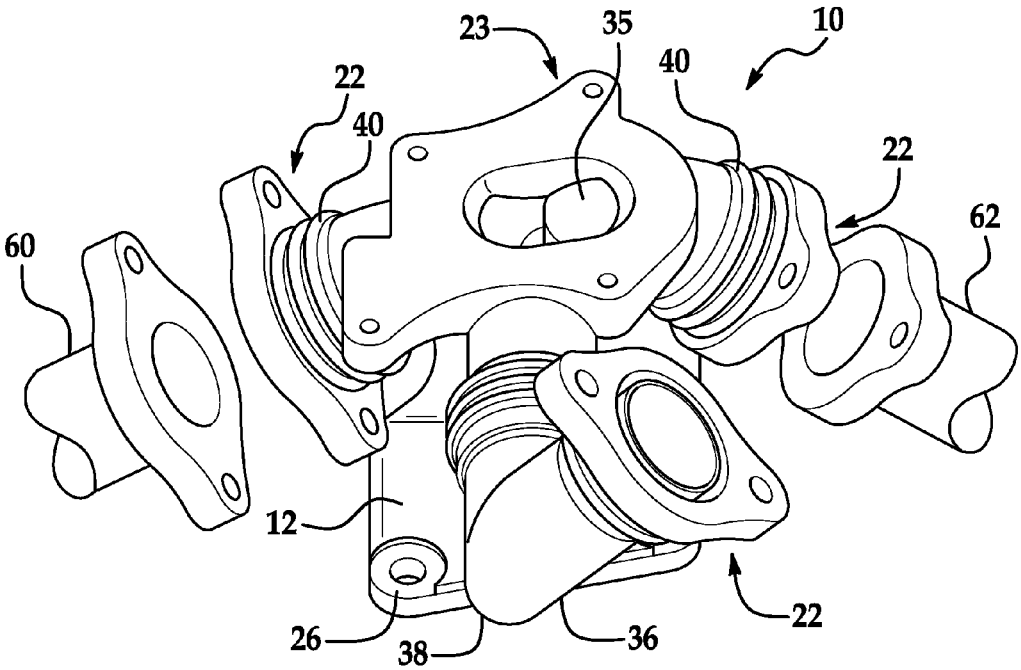
FIG. 2 illustrates a perspective view of the turbocharger mount shown in FIG. 1.
Figure 4:
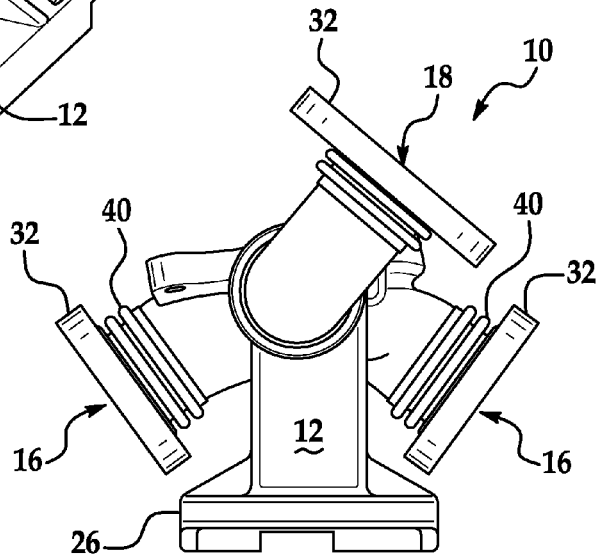
FIG. 4 illustrates a front view of the turbocharger mount shown in FIG. 1.
Figure 5:
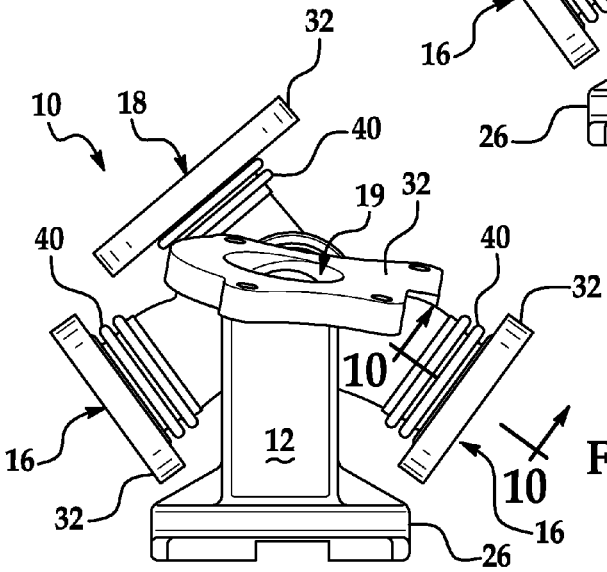
FIG. 5 illustrates a back view of the turbocharger mount shown in FIG. 1.
Figure 6:
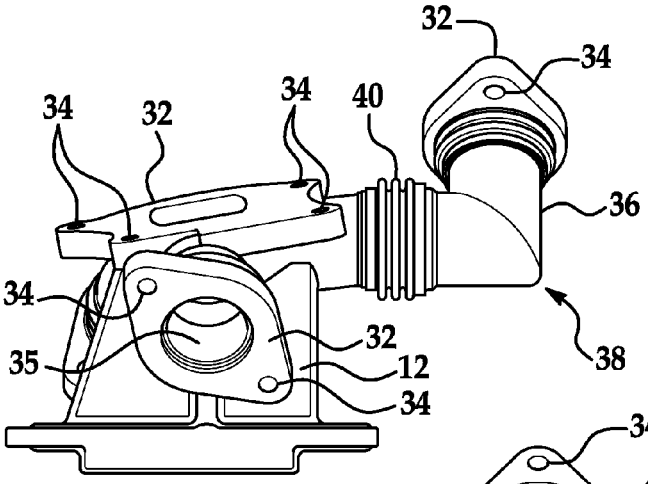
FIG. 6 illustrates a side view of the turbocharger mount shown in FIG. 1.
Figure 7:
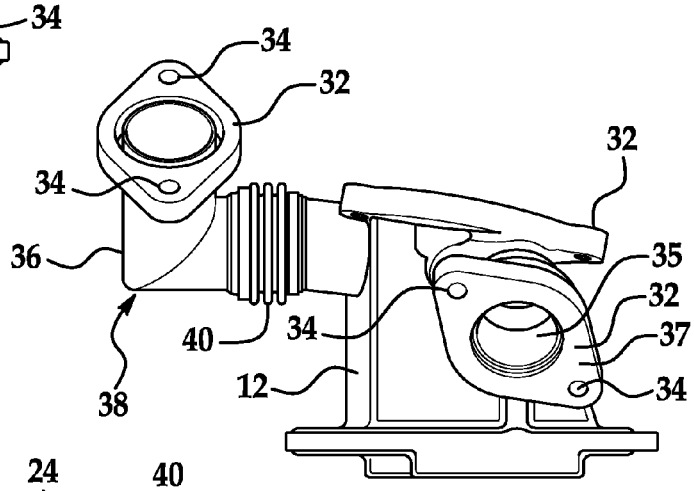
FIG. 7 illustrates another side view of the turbocharger mount shown in FIG. 1.
Figure 8:
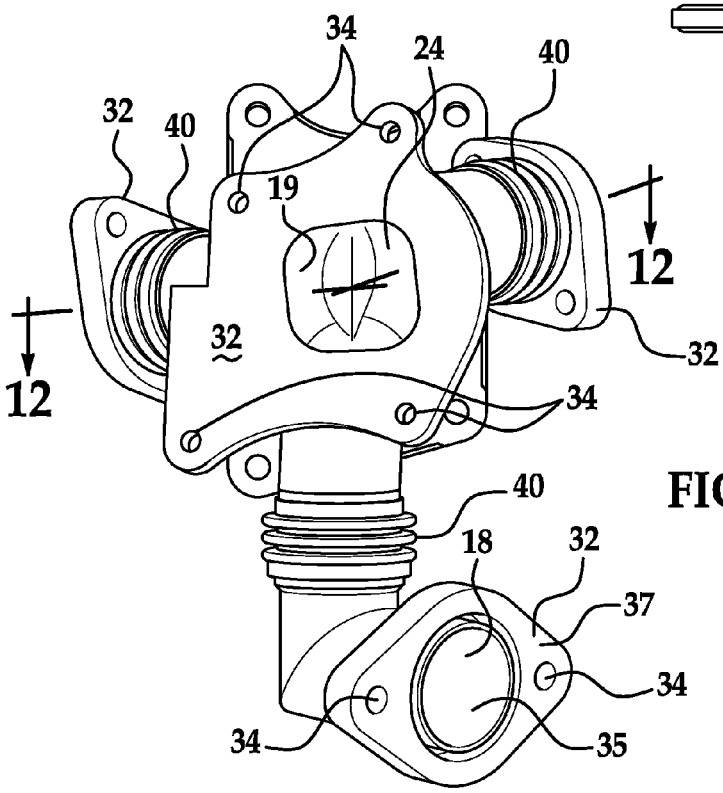
FIG. 8 illustrates a top view of the turbocharger mount shown in FIG. 1.

As illustrated in FIGS. 3-5, the turbocharger mount 10 includes a housing portion 12. The housing portion includes integrated passageways for fluid coupling the engine to the turbocharger and EGR device. In one embodiment, the housing includes one or more inlet openings 16 for receiving exhaust gas from the engine 14, an opening 19 for directing the exhaust gas to an inlet opening 56 of the turbocharger 20 and another opening 18 for directing exhaust gas to an EGR device 58. As shown in FIG. 8, the inlet openings and the outlet openings are fluidly connected through cavity 24. The turbocharger mount 10 further includes one or more attachment features 22, 23 for fluidly coupling the one or more inlet and/or outlet openings to corresponding components, such as first engine exhaust conduit 60, second engine exhaust conduit 62 or otherwise, as shown in FIGS. 1 and 2. In one configuration, attachment feature 23 is integrally formed with housing portion 12 for fluid coupling and mounting of the housing portion 12 with turbocharger 20. Attachment features 22 are connected to the housing portion through fluid conduits, such as flexible conduits 40 and/or conduit 36. In one preferred embodiment, one or more of the attachment features 22 are flexibly attached to the housing portion. This is particularly advantageous as manufacturing tolerances between components may vary, which makes it difficult to predict exact locations for connecting to corresponding components of the turbocharger mount. These attachment features 22, 23 are described in further detail herein.

Figure 12:
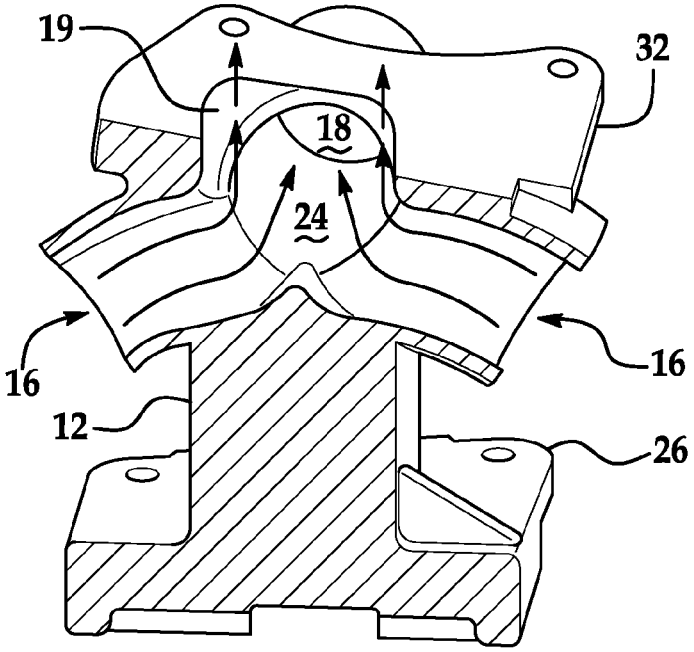
FIG. 12 illustrates a cross-sectional view taken along lines 12-12 of FIG. 8.

Fluid communication between the engine 14 and other components is provided by cavities, conduits, or flow paths formed through the housing portion. In one configuration, as shown in FIGS. 8 and 12, fluid communication is provided by a single cavity 24 disposed in the housing portion 12 and in fluid communication with the one or more inlet openings 16 and outlet openings 18, 19. In this configuration, fluid entering any one of the one or more inlet openings is free to exit any one of the one or more outlet openings. Alternatively, the housing portion 12 may have multiple cavities 24, wherein each cavity 24 is configured for joining an inlet opening 16 with one or more outlet openings 18, 19, an outlet opening 18, 19 with one or more inlet openings 16, or otherwise. In these alternative configurations, fluid entering a specific inlet opening can be restricted to exiting one or more specific outlet openings.

The cavity or cavities 24 are formed of any suitable shape for providing suitable fluid flow between the inlet openings 16 and outlet openings 18, 19. For example, in one non-limiting configuration the cross sectional area of the inlet opening 16, the outlet openings 18, 19 and the cavity 24 are generally equal to maintain constant fluid pressure through the resulting passageways of the turbocharger mount 10. In one alternative configuration, the cavity is configured with a cross-sectional area that is larger or smaller than a cross-sectional area of the inlet and/or outlet openings. In still another alternative configuration, the cavity is formed with a cross-sectional area generally equal to the sum of the inlet or outlet openings that the cavity is in fluid communication with. Other configurations are possible.

As previously mentioned, the turbocharger mount 10 is configured for attachment to the engine 14 or component thereof. In one configuration, with reference to FIG. 9, attachment of the turbocharger mount to the engine is facilitated through a mounting flange 26. In this configuration the mounting flange is integrally formed with the housing portion 12. However, it is possible that the mounting flange be separately formed and attached to the housing portion. The mounting flange 26 includes a mating surface 27 adapted to matingly engage a corresponding mating surface of the engine. In the illustrated embodiment, the mounting portion is further configured for mechanical attachment to the engine, such as through the use of fasteners 46 placed through one or more openings 28 formed through the mounting flange. Other means for fastening the mount to the engine may be employed such as rivets, clips, adhesives and combinations thereof.

The mounting flange 26 can be secured to engine components or non-engine components. With respect to engine components, the turbocharger mount 10 may be attached to an engine block, cylinder head, intake or exhaust manifold, or other engine components. Alternatively, the turbocharger mount may be attached to a frame member (e.g., vehicle frame or otherwise), panel member, or otherwise. In one exemplary embodiment, as shown in FIG. 1, the turbocharger mount 10 is attached to the engine block 44 through a plurality of fasteners 46.

The housing portion 12, and integrated components thereof, may be formed of any suitable material capable of withstanding high temperatures associated with engines as well as providing the desired structural support for the turbocharger 20. In one embodiment, the material forming the housing is cast iron, such as high temperature cast iron. In an alternative embodiment, the material forming the housing is a cast silicon-molybdenum iron (Si—Mo iron). The housing portion may also be formed through any suitable means (e.g., casting, molding, injection molding, etc.), wherein the material forming the housing portion comprises metal, metal alloy, ceramic, combinations thereof, or any other suitable material.

As previously described, with reference to FIGS. 2-9, the turbocharger mount 10 includes one or more attachment features 22, 23 for fluidly connecting one or more of the inlet openings 16 and/or outlet openings 18, 19 to the engine exhaust, turbocharger inlet 56 and EGR device 58. In one configuration, the attachment features 22, 23 include a flange 32 for attachment to a corresponding fluid component thereof. The flange includes an opening 35 for providing fluid flow therethrough. The flange also includes a mating surface 37 for engagement with the corresponding component. Advantageously, engagement with the corresponding component may be enhanced with a sealing feature (e.g., gasket, sealant material, adhesive, etc.) disposed on the mating surface. The flange is secured to the corresponding component through a suitable attachment feature such as one or more mechanical fasteners 47 extending through openings 34 formed in the flange.

As with the housing portion 12, the attachment features 22, 23 may be formed from any suitable material including any of the materials used to form the housing portion. For example, attachment feature 23 may be integrally formed with the housing portion 12 and be formed of the same material and through the same forming process. In contrast, attachment feature 22 may be separately formed and/or manufactured from the housing portion, which may be formed of the same or different material, and attached to the housing portion 12 through suitable means, such as flexible conduit 40, conduit 36 or otherwise.

Figure 9:
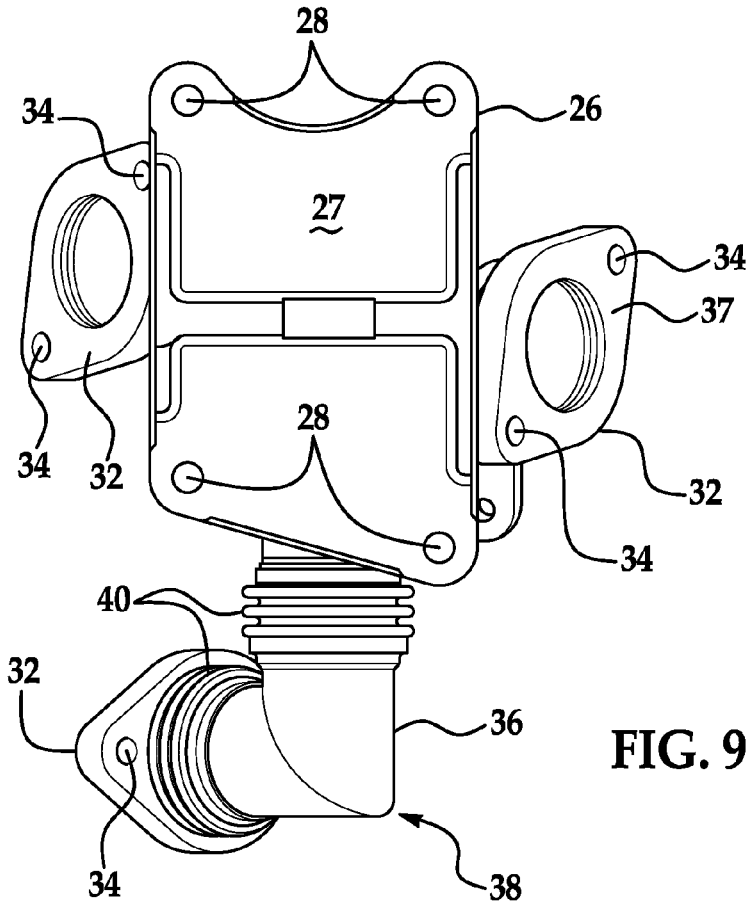
FIG. 9 illustrates a bottom view of the turbocharger mount shown in FIG. 1.

In one embodiment, as shown in FIGS. 2, 8 and 9, the turbocharger mount 10 includes a conduit 36 for connecting one of the attachment features 22 to the housing portion 12. Such conduit may be contoured along a length thereof to bring the flange proximate to a mating surface of a corresponding component. For example, the conduit 36 may include a contoured portion 38, such as an elbow, the like or otherwise to place the flange at a certain location and/or orientation with respect to the mounting surface of the corresponding component, such as a connector for an EGR device 58.

In one preferred embodiment, as shown in FIGS. 1-9, one or more of the attachment features 22 are connected to the housing portion 12 through the use of a flexible connector, such as a flexible conduit 40. The flexible conduit is particularly advantageous where the location of corresponding components to be attached to the turbocharger mount 10 vary between engines or applications. Also, the flexible conduit allows for thermal expansion of the components of the turbocharger mount, such as housing portion 12, conduit 36, flanges 22, 23 or even the flexible conduit 40 itself. These thermal expansion allowances not only corrects for movement of the turbocharger mount components during or after manufacturing, but also for movement of the components during operation of the turbocharger mount thereby reducing stress to the turbocharger mount and components attached thereto. Accordingly, the flexible conduit 40 provides for not only axial and lateral movement of the attachment feature flange 32, with respect to the housing portion 12, but also for rotational and bending movement. Further, not only can the position of the attachment feature be changed, but also the orientation of the mating surface 37.

Figure 10:
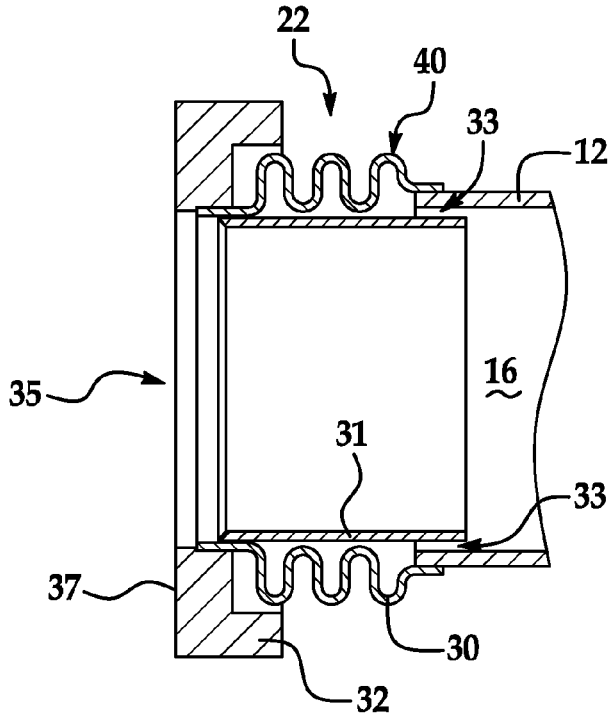
FIG. 10 illustrates a cross-sectional view taken along lines 10-10 of FIG. 5.
Figure 11:
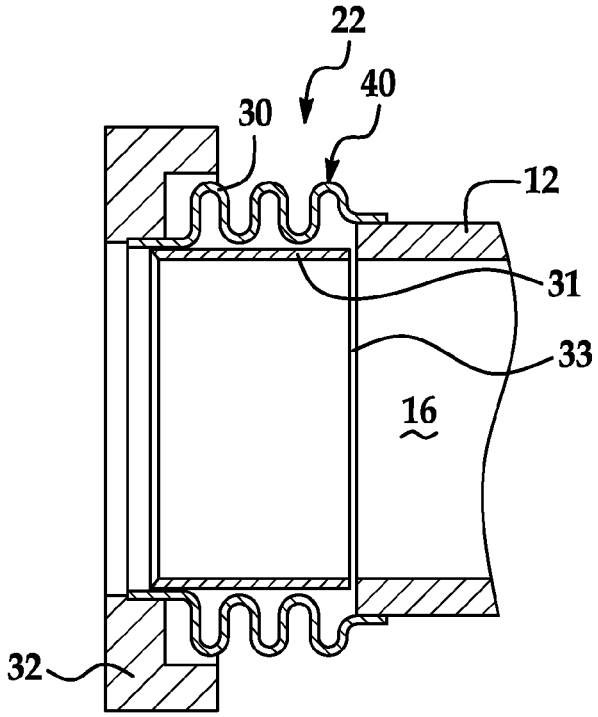
FIG. 11 illustrates an alternative embodiment of a turbocharger mount according to an exemplary embodiment of the present invention.

In one configuration, with reference to FIGS. 10 and 11 the flexible conduit 40 is attached to a flange 32 of the attachment feature 22 on a first end and attached to the housing portion 12, or conduit 36, on a second end. With reference to the outlet opening 18 being fluidly being coupled to an EGR device, as shown in FIGS. 2 and 3, multiple flexible conduits 40 may be used for attaching the attachment feature 22 and conduit 36 to the housing portion 12. In any of theses configurations, the flexible conduit is attached using any suitable attachment means. For example, the flexible conduit may be attached through the use of mechanical fasteners, friction fit, insert molding, adhesives, welding, combinations thereof or otherwise.

In one non-limiting embodiment, with reference to FIGS. 10 and 11, the flexible conduit 40 includes a flexible portion 30 having a non-uniform surface configuration such as an accordion-like surface (e.g., corrugated, bellowed or equivalents thereof). In this configuration, the non-uniform surface includes a plurality of peaks and valleys to allow movement of the attachment features 22 with respect to the housing portion 12.

In one embodiment, still with reference to FIGS. 10 and 11, the turbocharger mount 10 may further include a sleeve 31 located within the flexible conduit 40. The sleeve provides a uniform interior surface free of irregularities, which allows for smooth fluid flow through the sleeve as well as the flexible conduit. Further, this configuration reduces potential hot spots forming on the peaks and valleys of the flexible portion 30. Referring to FIG. 10, a first configuration of a flexible conduit 40 and sleeve 31 is shown. In this configuration a first end of the flexible portion 30 and sleeve 31 are attached to flange 32 through a welding process. The second end of the flexible member 40 is attached to housing portion 12 while the second end of sleeve 31 is cantilever and forms a gap 33 between the sleeve and housing. This gapped configuration allows relative movement of the sleeve with respect to the housing with little to no binding therebetween. In a second configuration, referring to FIG. 11, the second end of sleeve 31 ends prior to reaching housing portion 12. As with the configuration shown in FIG. 10, this configuration also forms a gap 33 which allows movement of the sleeve with respect to the housing with little to no bind therebetween. This configuration is particularly advantageous where the housing portion is formed through a casting process. It should be appreciated that other configurations are possible.

The flexible conduit 40 is formed of any suitable material that provides flexibility. Such flexibility may comprise mechanical deformation, elastic deformation, plastic deformation, combinations thereof, or otherwise. The material is also heat resistant to withstand elevated temperatures consistent with engine exhaust gas, without appreciable plastic deformation. For example, the material forming the flexible conduit is configured to withstand temperatures ranging from about 600° F. to 1200° F. or more, without appreciable plastic deformation resulting in the destruction of the flexible conduit. Suitable materials for forming the flexible conduit include metal and metal alloys. One particularly suitable material comprises steel, such as stainless steel.

The turbocharger mount provides a versatile mounting system capable of fluidly connecting an engine to a turbocharger. As should be appreciated, the mount can be used in many different non-limiting engine applications. For example, the mount system can be used with a stand alone engine such as power generating engine, compressor engine, or otherwise. The turbocharger mount can be used with vehicle engines such as automotive engines, aircraft engines, marine engines railway engines or otherwise. In one application, the turbocharger mount is configured for use with an automotive vehicle to mount a turbocharger to an engine of the vehicle.

In addition, referring to FIGS. 1, 2, 3 and 12, a method for fluidly coupling an inlet opening 56 of a turbocharger 20 to an exhaust component (e.g., first and second exhaust conduit 60, 62) of an engine 14 is also provided. The inlet opening 56 is hidden between the turbocharger mount 10 and turbocharger 20 but includes a similar size and shape opening to that of outlet opening 19. The method includes receiving exhaust gas from an internal combustion engine 14 into a cavity 24 of a turbocharger mount 10. The gas is received through one or more inlet openings 16 of the turbocharger mount and a portion of the exhaust gas received by the cavity is directed into the inlet opening 56 of the turbocharger 20 through outlet opening 19 formed by the turbocharger mount 10. In addition, another portion of the exhaust gas received by the cavity is directed into an exhaust gas recirculation device 58 through outlet openings 18. It is contemplated that the method disclosed herein utilizes various features of the turbocharger mount 10, as described herein. For example and in one embodiment, the turbocharger mount 10 includes one or more flexible conduits 40 for fluidly connecting the one or more inlet openings 16 to an exhaust component of the engine. Similarly, one or more flexible conduits 40 may be used to connect outlet opening 18 to the exhaust gas recirculation device 58. The method further comprises mounting the turbocharger mount to an engine 14, engine component or otherwise. For example, the turbocharger mount 10, and hence the turbocharger 20, are mounted to an engine block 44 or cylinder head or other structure, via a mounting flange 26 of the turbocharger mount.

While exemplary embodiments have been described and shown, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A turbocharger mount for fluidly coupling a turbocharger to an exhaust system of an engine, the turbocharger mount comprising:

a housing portion;

an attachment flange configured to couple the turbocharger mount to the turbocharger; and a mounting flange extending from the housing portion configured to couple the turbocharger mount to the engine and maintain the housing in a desired position, the housing portion defining a cavity therein, the housing portion further defining a first inlet opening in fluid communication with the cavity, a first outlet opening in fluid communication with the cavity, and a second outlet opening in fluid communication with the cavity, wherein the housing portion defines a second inlet opening in fluid communication with the cavity, the turbocharger mount further comprises a first flange defining an opening fluidly coupled to the first inlet opening by a first flexible conduit and a second flange defining an opening fluidly coupled to the second inlet opening by a second flexible conduit, the first flexible conduit allows relative movement of the first flange with respect to the housing portion and the second flexible conduit allows relative movement of the second flange with respect to the housing portion.

2. The turbocharger mount as in claim 1, wherein the first flexible conduit includes a flexible portion having a corrugated portion that provides for relative movement of the first flange with respect to the housing portion.

3. The turbocharger mount as in claim 2, wherein a sleeve is disposed inside the first flexible conduit, the sleeve being connected to the first flange and having a substantially uniform surface for providing uniform fluid flow through the flexible conduit.

4. The turbocharger mount as in claim 3, wherein the sleeve is not directly secured to the housing portion and a portion of the sleeve is in a facing spaced relationship with respect to the housing portion to allow relative movement of the first flexible conduit with respect to the housing portion.

5. The turbocharger mount as in claim 1, wherein the first flexible conduit and the second flexible conduit each include a flexible portion having a corrugated portion that allows relative movement of the first flange and the second flange with respect to the housing portion.

6. The turbocharger mount as in claim 1, further comprising a third flange defining an opening fluidly coupled to the second outlet opening by a third flexible conduit, the third flexible conduit allowing relative movement of the third flange with respect to the housing portion.

7. The turbocharger mount as in claim 6, wherein the attachment flange is configured to fluidly couple the first outlet opening to an inlet opening of the turbocharger, the attachment flange being configured to secure the turbocharger to the turbocharger mount, the attachment flange also being integrally formed with the housing portion to form a unitary structure.

* * * * *